US006116379A

United States Patent [19]

Huss

[11] Patent Number: 6,116,379

[45] Date of Patent: Sep. 12, 2000

[54] LADDER STABILIZING CROSS BRACE

[75] Inventor: Michael A. Huss, 950 Bramblebush Cir. W., Port Orange, Fla. 32127-4862

[73] Assignee: Michael A. Huss

[21] Appl. No.: 08/967,839

[22] Filed: Nov. 12, 1997

[51] Int. Cl.[7] ..... E06C 1/00

[52] U.S. Cl. ..... 182/165; 182/170; 182/172

[58] Field of Search ..... 182/165, 166, 182/167, 168, 169, 170, 171, 177, 104, 172, 174, 175, 176

[56] References Cited

U.S. PATENT DOCUMENTS

| | | | |
|---|---|---|---|
| 44,391 | 9/1864 | Booher | 182/165 |
| 701,532 | 6/1902 | Bardin | 182/165 X |
| 970,690 | 9/1910 | Davis | 182/165 X |
| 1,342,881 | 6/1920 | Udell | 182/165 |
| 1,942,849 | 1/1934 | Thrasher | 182/165 |
| 2,368,915 | 2/1945 | Brandel | 182/165 X |
| 2,469,559 | 5/1949 | Johns | 182/165 |
| 3,005,513 | 10/1961 | Larson | 182/165 |
| 4,011,926 | 3/1977 | Larson et al. | 182/107 |
| 4,147,231 | 4/1979 | Chantler et al. | 182/175 |
| 4,249,637 | 2/1981 | Glasglow | 182/170 |
| 4,519,477 | 5/1985 | Ralston | 182/107 |
| 4,600,080 | 7/1986 | Forrester | 182/124 |
| 4,718,518 | 1/1988 | Brown | 182/165 X |
| 4,796,727 | 1/1989 | Eaton | 182/168 |
| 5,305,851 | 4/1994 | Katson et al. | 182/204 |
| 5,462,133 | 10/1995 | Merrill, Jr. et al. . | |
| 5,590,739 | 1/1997 | High et al. | 182/169 |

OTHER PUBLICATIONS

Platform ladder catalogue Sep. 97.

*Primary Examiner*—Daniel P. Stodola
*Assistant Examiner*—Richard M. Smith

[57] ABSTRACT

A ladder stabilizing system having a solid brace (50 or 46) or the combination of side spreaders (24C), the ladder sections (10 and 12), and a diagonal cross brace (18) creating two rigid triangles, the function of which is to prevent the ladder sections from twisting or flexing and therefore make the step ladder or the side braces (70 & 74) of a ladder or step ladder much more stable and will prevent the ladder sections (10 and 22), or extended side braces from twisting or flexing, thereby making the ladder stronger and safer.

4 Claims, 4 Drawing Sheets

LADDER STABILIZING CROSS BRACE

BACKGROUND-FIELD OF INVENTION

This invention relates to ladders, specifically to stabilizers which decrease the possibility of the ladder twisting, slipping or tipping by making the base of the ladder more rigid.

DESCRIPTION OF PRIOR ART

Previous Inventions have increased the stability of ladders in several ways. These methods include:

1. By increasing the span of their bases with outrigger type side braces such as in U.S. Pat. No. 4,147,231 by Cantler, U.S. Pat. No. 4,519,477 by Ralston, U.S. Pat. No. 4,011,926 by Larson and many others.
2. By making the length of the ladder's legs adjustable so as to allow the ladder to stand vertically on uneven terrain conditions, such as in U.S. Pat. No. 5,305,851 by Katson and U.S. Pat. No. 5,462,133 by Merrill.
3. Back braces: Tripod ladders typically have two spreaders holding a single leg to the back of the ladder. U.S. Pat. No. 5,590,739 High, U.S. Pat. No. 4,249,637 Glasglow, U.S. Pat. No. 4,600,080 Forester. These spreaders are positioned one half to two thirds the-way up the ladder and are not sufficiently near the base of the ladder to prevent the back leg or the ladder section from twisting or flexing.
4. Both back brace and outrigger U.S. Pat. No. 4,796,727 Eaton. Another type of ladder is the platform stepladder where the top step is a large platform upon which a person can stand. The platform is pivotally connected to both the front section and the support section. Again the connection is not sufficiently near the base of the ladder to prevent the support section especially from twisting.

None of these inventions prevent the ladder or sections of a stepladder from flexing or twisting. They do not strengthen the structure of the ladder near the base.

No prior art exists in which a stepladder has been made more stable by connecting the feet or legs to one another near the base. Nor is there any prior art in which a ladder's outrigger type side braces are connected to the ladder's legs and/or one to another near the base by a triangulated bracing system. This type of connection or triangulated bracing system would make all the legs of the ladders and/or the side braces more stable in relation to each other by preventing them from moving independently and would help prevent the ladder from flexing or twisting. The sections of the stepladder, especially the support section, are not perfectly rigid and can flex. The spreaders on a typical stepladder are placed one half to two thirds up the side of the stepladder, not near the feet. These spreaders prevent the front and back sections from moving toward or away from one another at the point of the spreaders but they do not prevent the back or front section from flexing or sliding in a plane parallel to each other. Likewise they do not prevent the left side of the stepladder from moving in a plane parallel to the right side of the stepladder. And they do not prevent the sections from flexing or twisting above or below the spreaders. In other words the front and the back sections of the stepladder twist. When a section flexes, an individual foot can move in relation to the others. When this happens the two diagonal feet of the stepladder move lower in relation to the other two feet thus making the stepladder stand or rock on two feet rather than stand solidly on four feet, a very unsafe condition.

OBJECTS AND ADVANTAGES

Several objects and advantages of my invention are:

(a) To provide a triangulated cross bracing to hold the feet of a stepladder stable in relation to one another in a manner which will help prevent the ladder from flexing, twisting and slipping and collapsing.

(b) to provide a triangulated cross brace for a stepladder that will fold with the stepladder.

(c) to provide an additional shelf to put tools and materials upon.

(d) to provide a triangulated cross brace to hold the extended side braces of a ladder stable in relation to the rest of the ladder.

(e) to provide a bracing system which will allow stepladder sections or ladder side braces to be extended at varying distances.

(f) to provide a triangulated ladder bracing system that can be retrofitted to existing ladders.

Further objects and advantages of my invention will become apparent from a consideration of the drawings and ensuing description.

DRAWING FIGURES

PREFERRED EMBODIMENT DESCRIPTION

Figure 1B:
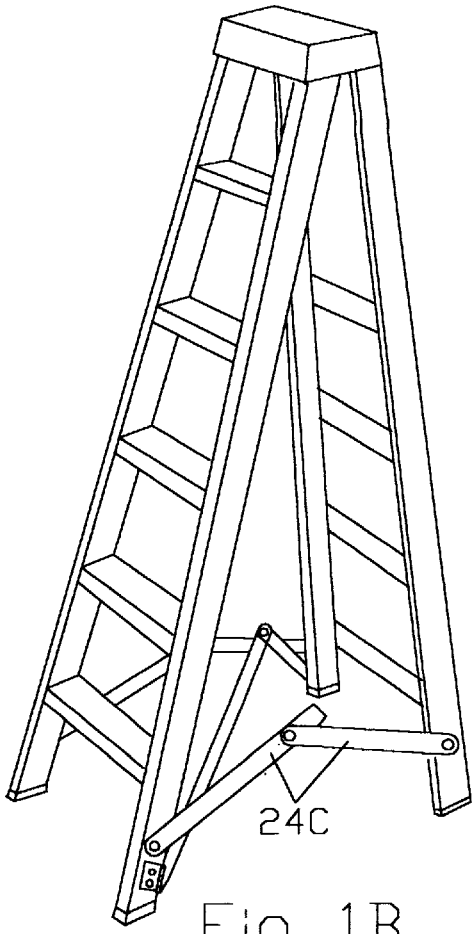
FIG. 1B shows the stepladder partially closed with the triangulated cross bracing partially folded.
Figure 1A:
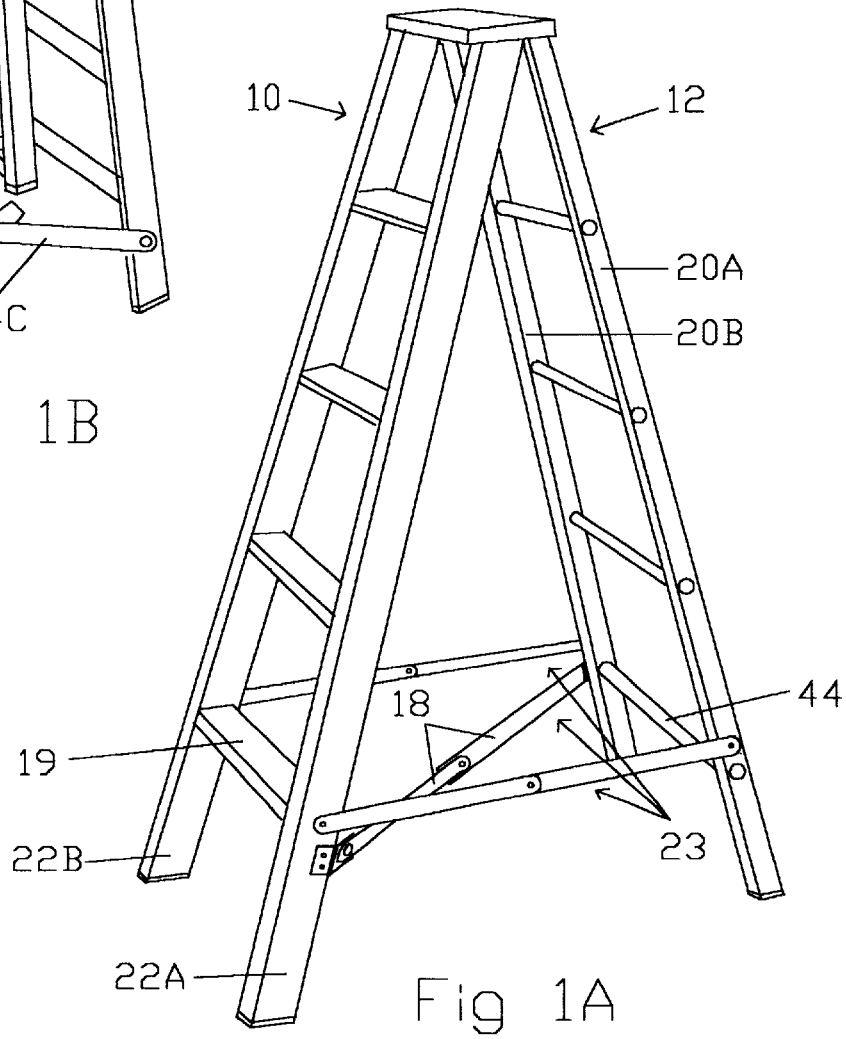
FIG. 1A Shows a stepladder with triangulated cross bracing.
Figure 2A:
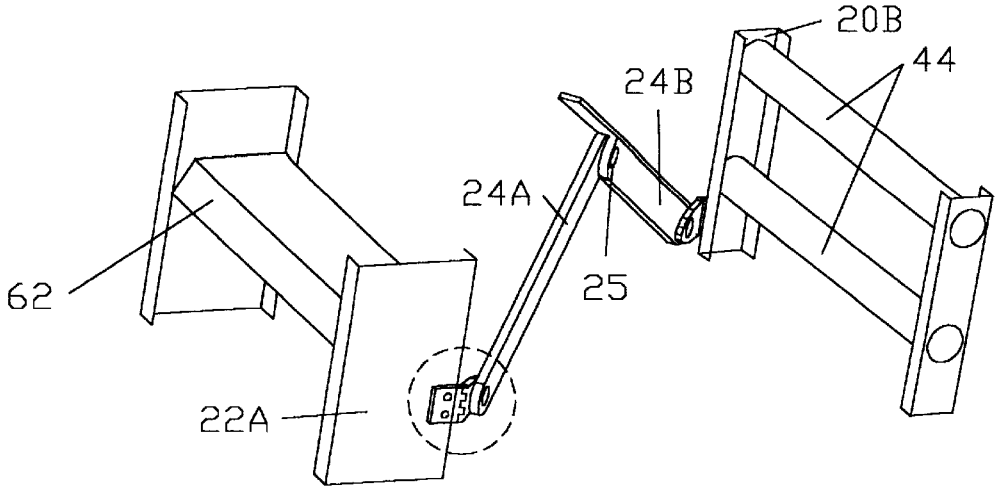
FIG. 2A shows a folding cross brace system with a compound folding hinge and pivot attachment, partially closed, on the lower section of a step ladder.

The preferred embodiment of the present invention is illustrated in FIGS. 1A&B and FIGS. 2A&B. FIGS. 1A&B are isometric views of a stepladder fully opened (1A) and partially closed (1B) with a folding triangulated cross bracing system 23 at the base of the stepladder. The cross brace, in it's extended position, connects diagonal legs of the stepladder near the base of the ladder. In addition to folding up like a spreader, the folding cross brace of the referred embodiment must fold sideways into a plane parallel to the front and back sections of the stepladder when the stepladder is folded. This is accomplished by connecting the ends of the folding diagonal cross brace by a compound folding connecting means to the support rail 20A or B and the diagonal side rail 22A or B.

This embodiment includes a folding member diagonal cross brace 18 which connects one pair of diagonal corners of the stepladder. It also includes side spreaders 24C acting as braces between the front section 10 and the support section 12 of the stepladder. Together the side spreaders, the folding diagonal cross brace, bottom step 62, and back rail connector 44, work together to complete the triangles of the triangulated cross brace system.

The connecting means must fold both horizontally and vertically. This connecting means could be the compound folding hinge attaching system 27 of FIG. 2A. In FIG. 2A the folding member diagonal cross brace is comprised of two folding diagonal cross brace pieces 24A&B. They are connected in the center by center pivot 25. The ends are connected by end pivots 26 to hinge leafs 28A. These pivots allow the cross brace to fold up and down like a spreader. The other half of the hinge leafs 28B, are connected to a side rail and the diagonal support rail by hinge attaching rivets 30 or similar attaching device. The hinge allows the cross brace to fold horizontally in between the ladder sections when closing. The hinges are connected with two hinge attaching rivets each or any other similar fastening method such as nuts and bolts or screws. This would allow easy retrofitting to existing ladders.

Figure 2B:
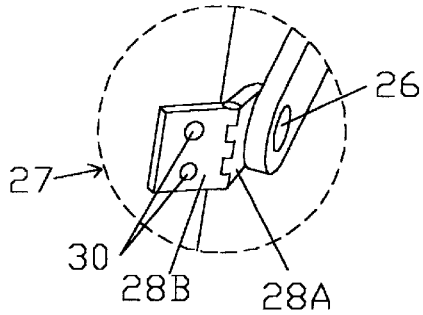
FIG. 2B shows a partial view of FIG. 2A compound folding hinge and pivot system.

FIG. 2B shows a partial view of FIG. 2A with the components of a compound folding hinge.

The combination of side spreaders, the ladder sections, and diagonal crossbrace of FIGS. 1A&B creates two rigid triangles, the function of which is to hold each leg of the ladder from moving closer or further away form any of the other leg. This prevents the ladder sections from twisting or flexing and therefore makes the ladder much more stable and less likely to move or collapse.

SINGLE AND SOLID STRUCTURE—DESCRIPTION

Figure 2C:
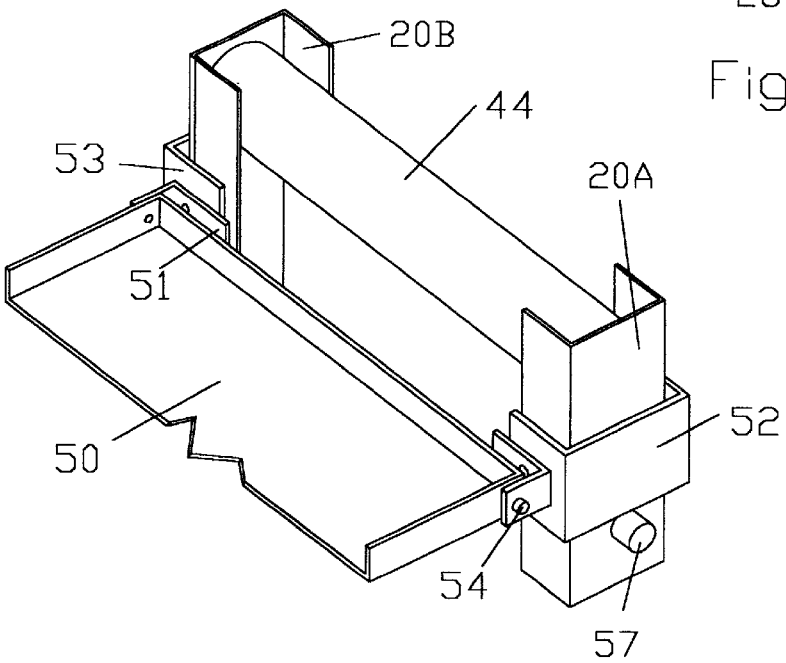
FIG. 2C shows a shelf as a cross brace system with a sliding attachment.
Figure 3:
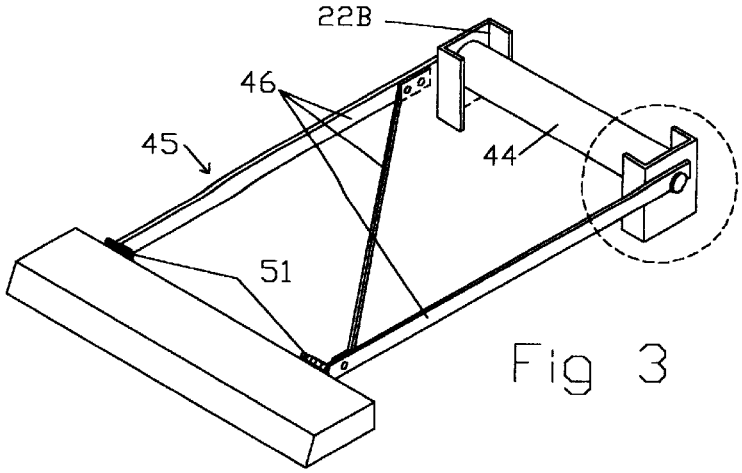
FIG. 3 shows a hinged triangulated cross brace made of three pieces fixed together into a single structure with a slot over peg attaching system.
Figure 3A:
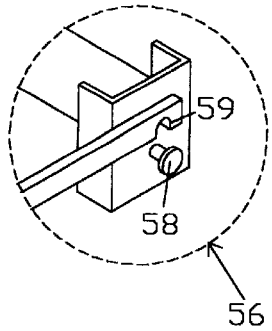
FIG. 3A is a partial view of FIG. 3 Peg over slot removable attachment.
Figure 4A:
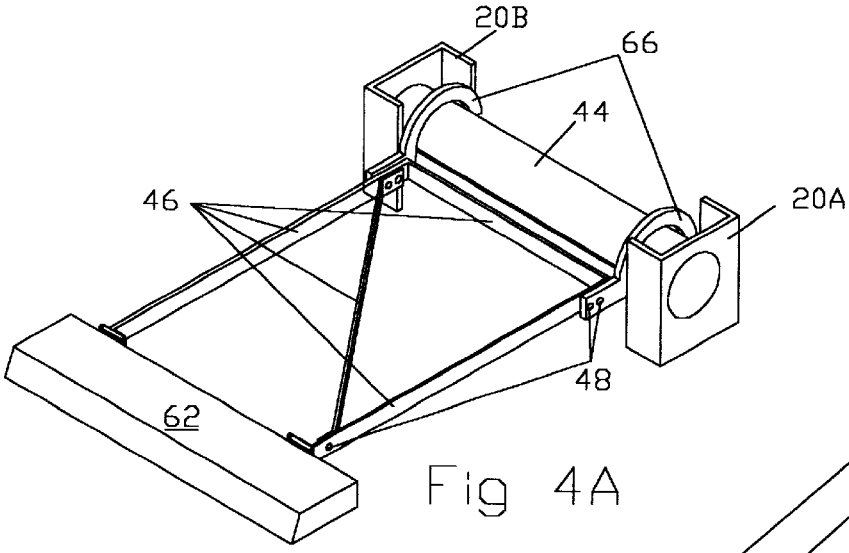
FIG. 4A shows the hinged four-piece single structure of FIG. 3 with an inverted U attaching system over a back rail connector.

The function of the single and solid structure embodiments of the crossbrace, such as in FIGS. 2C,3,4A&B is the same as with the folding crossbrace. It is to make connections at or near all four corners of a step ladder near the base to make it more stable. They are the single structure 45 of FIGS. 3&4A and a similar structure the solid shelf 50 of FIGS. 2C and 4B. The single structure of FIGS. 3&4A is three or four rigid pieces for single structure cross brace 46 connected together by single structure connecting rivets 48 into a single structure the shape of a Z. The top and bottom of the Z correspond to the left and right sides of the ladder. The left end of the Z is hinged to or near the bottom step with single structure hinge 51. There is a removable attaching means to hold the other end of the Z onto the support section. The fourth rigid piece connects the right side of the Z together to keep it from flexing when used with a removable attaching system such as FIG. 4A inverted U 66 or FIG. 2C sliding attachment 52 where the attachment could be compressed in a horizontal direction. The inverted U is connected to the with single structure connecting rivets 48.

The alternative attaching system sliding attachment for single and solid structures of FIGS. 2C and single structures of FIGS. 3 and 4A. The sliding attachment is a piece of rigid material wrapped around the back supports rails so as to allow sliding attachment to slide up and down the support rails. It is attached to the solid structure by sliding attachment mounting bracket 53 and sliding attachment pivot 54, and is stoped from sliding lower than intended by stop peg 57 which is extending form the support rails.

FIGS. 3,4A & B show other possible removable attaching systems for single and solid structures. They are: in FIG. 3, the slot over peg attaching system 56 for a single structure crossbrace system. Slotted bars attached to, or extension of the single structure near the support section has slots 59 cut in their lower edges which slides over corresponding nail head shaped stop pegs 58 which are attached to the support section. The slots and stop pegs hold the single structure crossbrace to the support section thereby prevention the ladder sections from twisting.

Another attaching system is shown in FIG. 4A. A four piece single structure cross brace is attached to the back rail connector 44 with a piece of rigid material the shape of an inverted U 66 wrapped over the back rail. The inverted U is connected to the single structure with connecting rivets 48.

Figure 4B:
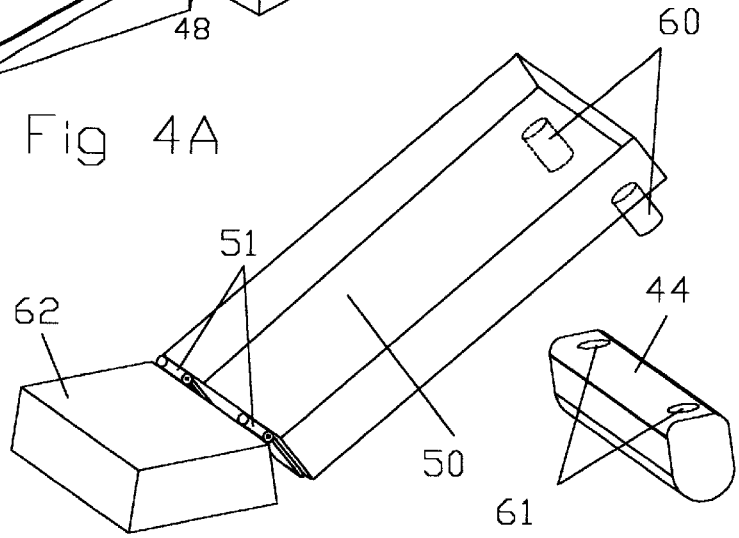
FIG. 4B shows a solid shelf as a single structure cross brace with a pin in hole attachment.
Figure 5:
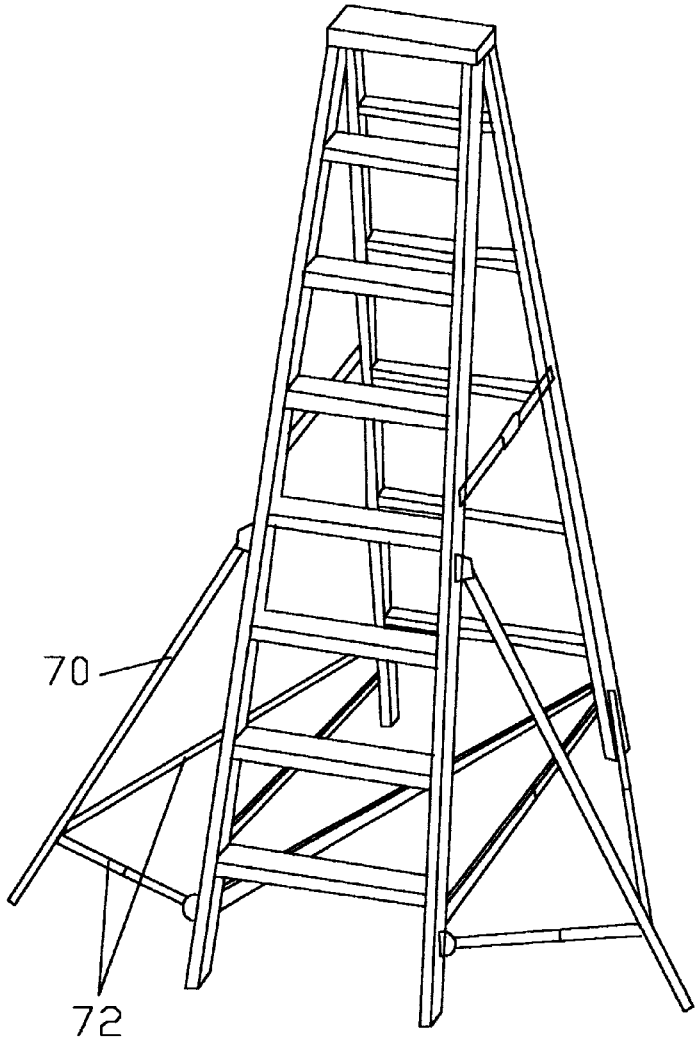
FIG. 5 is a stepladder with side braces held stable with triangulated cross bracing.
Figure 6:
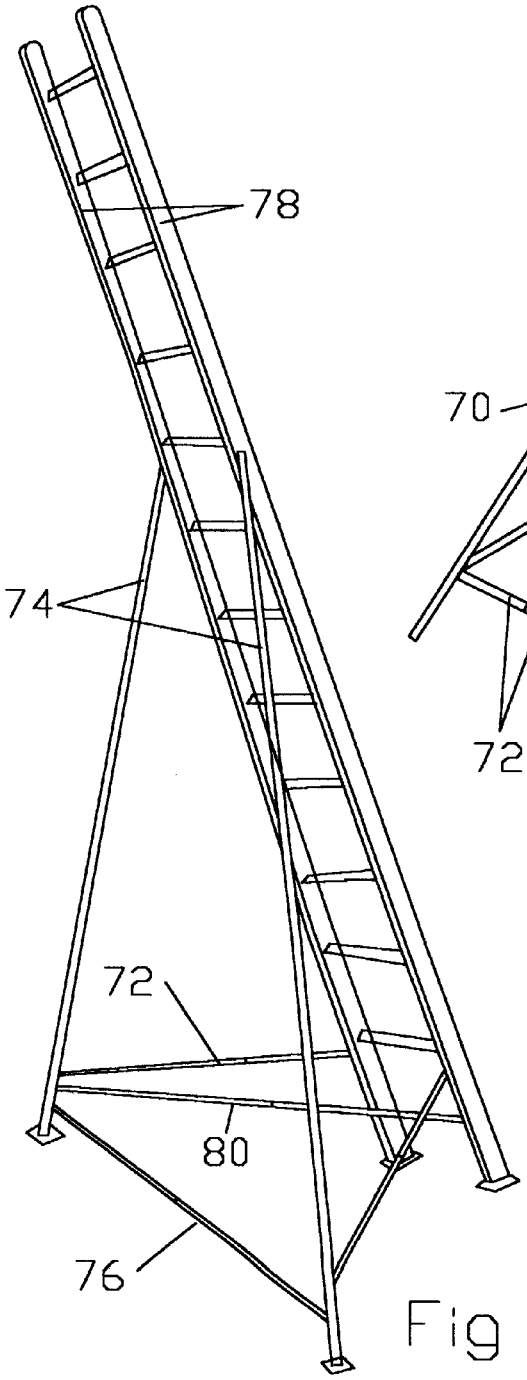
FIG. 6 shows a ladder with side braces with triangulated cross bracing.

In FIG. 4B the shelf as a solid single structure is attached to the backrail with two drop pins 60 protruding from the under side of the shelf or single structure which fit into two corresponding drop pin holes 61 in the backrail connector to hold the shelf stable.

STEP LADDER SIDE BRACE CROSS SYSTEM—DESCRIPTION

The step ladder side braces 70 are held away from the ladder side rails by sidebrace spreaders 72. They are connected to the support sections by more side brace spreaders. The stepladder has a typical cross brace system. The side braces are held stable by the triangle created by the side brace spreaders and the step ladder spreaders.

LADDER SIDE BRACE CROSS SYSTEM—DESCRIPTION

The ladder side braces 74 are held away from the ladder side rails 78 by side brace spreaders 72. At least one of the two side braces are connected to the oposite side rail by a ladder cross brace 80. The side braces are connected to each other by a side brace back brace 76.

REFERENCE NUMERALS IN DRAWINGS

10 front section
12 support section
18 folding member diagonal cross brace
19 bottom step
20A support rail right
20B support rail left
22A side rail right
22B side rail left
23 folding triangulated cross brace system
24A&B folding diagonal cross brace pieces
24C side spreaders
25 center pivot
26 end pivot
27 compound folding hinge attaching system
28A&B hinge leafs
30 hinge attaching rivot
32 ball and socket attachment
34A&B folding member tubes
36 bolt and wing nuts
38 multi position locking ratchet
44 back rail connector
45 single structure
46 rigid pieces for single structure cross brace
48 single structure connecting rivots
50 solid shelf
51 single structure hinge
52 sliding attachment
53 sliding attachment mounting bracket
54 sliding attachment pivot

56 slot over peg attachment
57 stop peg
58 nail head shaped stop peg
59 slot
60 drop pin
61 drop pin hole
62 bottom step
66 inverted U
70 step ladder side brace
72 side brace spreader
74 ladder side braces
76 side brace back brace
78 ladder side rails
80 ladder cross brace Although the descriptions above contain several specificities, these should not be construed as to limit the scope of the invention but as to merely to provide illustrations of some of the presently preferred embodiments of this invention. For example an additional crossbrace could be put in the center of the ladder or near the top in conjunction with the existing folding tool shelf. Or there could be two crossbraces spanning both diagonals between all four legs of a stepladder separate or joined by a single hinge in the center. The connecting system could be any of those previously delineated or another alternative connecting means could be used such as a short flexible hose affixed with U bolts and hose clamps, universal joints or similar.

Thus the scope of the invention should be determined by the appended claims and their legal equivalents, rather than by the examples given.

What is claimed is:

1. A ladder with a stabilizing folding triangulated cross brace system including (a) a ladder front section having a structural side rail on a left side of said ladder and a structural side rail on a right side of the ladder connected by a multiplicity of steps, said front section connected to (b) a support member having two or more support rails including a support rail on the left side of the ladder and a support rail on the right side of the ladder connected by a multiplicity of connecting bars, and (c) the stabilizing folding triangulated cross brace system including a first spreader having a first and second end, said first spreader first end adjacent a lower one of said steps, said first spreader extending generally horizontally from the left structural side rail toward and connected to the left support rail when said ladder is fully opened, a second spreader having a first and second end, said second spreader first end adjacent said lower one of said steps, said second spreader extending generally horizontally from the right structural side rail toward and connected to the right support rail when said ladder is fully opened, a third spreader connected to diagonally opposed rails together forming two triangles with the first and second spreaders, the lower one of said steps of the front section, and a lower one of the connecting bars of the support member, said spreaders providing a triangulation of cross bracing for the ladder for preventing the front section and the support member from flexing or twisting and (d) a foldable connecting means for attaching the third spreader to the diagonally opposed rails of the ladder.

2. The ladder with the stabilizing folding triangulated cross brace system of claim 1 including a means for connecting the third spreader at each end comprising a compound folding hinge with each said compound hinge having two pivotally connected plates with one said plate connected to one of two diagonally opposed rails of the ladder and a second said plate of each hinge connected to said ends of said third spreader by a pivot for allowing said third spreader to fold in both a horizontal and a vertical axis when the ladder is opened and closed.

3. The ladder with the stabilizing folding triangulated cross brace system of claim 2 further including a left side brace connected to the left structural rail and a right side brace connected to the right structural rail, said braces providing lateral support for the ladder, a fourth spreader having a first and second end, the first end of the fourth spreader pivotally connected to the left structural rail by a compound folding hinge, the second end of the fourth spreader pivotally connected to the left side brace, a fifth spreader having a first and second end, the first end of the fifth spreader pivotally connected to the left support rail by a compound folding hinge, the second end of the fifth spreader pivotally connected to the left side brace, a sixth spreader having a first and second end, the first end of the sixth spreader pivotally connected to the right structural rail by a compound folding hinge, the second end of the sixth spreader pivotally connected to the right side brace, a seventh spreader having a first and second end, the first end of the seventh spreader pivotally connected to the right support rail by a compound folding hinge, the second end of the seventh spreader pivotally connected to the right side brace, said spreaders thereby providing a triangulation of crossbracing for stabilizing the side braces.

4. The ladder with the stabilizing folding triangulated cross brace system of claim 1 wherein the third spreader has a first and second end, wherein the first end of the third spreader is nonpivotally connected to the first end of one of the first and second spreaders and the second end of the third spreader is nonpivotally connected to the second end of the other of the first and second spreaders.

* * * * *